US006613983B1

(12) United States Patent
Shukushima et al.

(10) Patent No.: US 6,613,983 B1
(45) Date of Patent: Sep. 2, 2003

(54) THIN-CONDUCTOR FOAMED-POLYOLEFIN-INSULATED WIRE AND MANUFACTURING METHOD THEREOF

(75) Inventors: Satoshi Shukushima, Kanuma; Taro Fujita, Osaka; Atsushi Tsujino, Kanuma; Yoshihiro Hirakawa, Kanuma; Masato Sano, Kanuma; Hiroyuki Ootsuka, Kanuma, all of (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/597,256

(22) Filed: Jun. 19, 2000

Related U.S. Application Data

(63) Continuation-in-part of application No. 09/196,740, filed on Nov. 20, 1998, now abandoned.

(30) Foreign Application Priority Data

Jan. 20, 1998 (JP) ..... 10-021585

(51) Int. Cl.[7] ..... H01B 3/00
(52) U.S. Cl. ..... 174/110 F
(58) Field of Search ..... 174/110 R, 110 F, 174/120 R, 120 C, 120 AR, 110 PM, 110 SR

(56) References Cited

U.S. PATENT DOCUMENTS

| | | | | |
|---|---|---|---|---|
| 4,683,166 A | 7/1987 | Yuto et al. | 428/314.8 |
| 4,845,145 A | 7/1989 | Inoue et al. | 524/436 |
| 4,987,165 A | 1/1991 | Orikasa et al. | 523/435 |
| 5,110,998 A | 5/1992 | Muschiatti | 174/24 |
| 5,175,204 A | 12/1992 | Orikasa et al. | 524/504 |
| 5,179,160 A | 1/1993 | Orikasa et al. | 525/66 |
| 5,185,398 A | 2/1993 | Kehr et al. | 525/74 |
| 5,194,182 A | 3/1993 | Kissel | 252/518 |
| 5,227,103 A | 7/1993 | Muschiatti | 264/45.9 |
| 5,418,272 A | 5/1995 | Kawabata et al. | 524/436 |
| 5,473,016 A | 12/1995 | Fujii et al. | 525/74 |
| 6,239,377 B1 * | 5/2001 | Nishikawa | 174/110 R |

FOREIGN PATENT DOCUMENTS

| | | |
|---|---|---|
| JP | 58-175216 | 10/1983 |
| JP | 03-067407 | 3/1991 |

OTHER PUBLICATIONS

Japanese 61–114412, Apr. 2, 1986 (corresponding to USP 4 686 166).
Japanese 63–56652, Nov. 9, 1988 (and partial English–language translation).
Japanese 48–42314, Dec. 12, 1973 (and English–language Abstract).
Japanese 6–16371, Mar. 2, 1994.
Japanese 39–6810, May 8, 1964 (and partial English–language translation).
Office Action from Japan Patent Office dated May 14, 2002 and translation.

* cited by examiner

*Primary Examiner*—Chau N. Nguyen
(74) *Attorney, Agent, or Firm*—Smith, Gambrell & Russell, LLP

(57) ABSTRACT

A foamed-polyolefin-insulated wire having a conductor diameter of 0.4 mm or less and an insulation thickness of 0.8 mm or less and satisfying, an equivalent dielectric constant less than 1.6, the fluctuation limits of the equivalent dielectric constant less than or equal to ±0.1, and conductor stripping force greater than or equal to 100 g/50 mm. Polyolefin including 10 weight % or more of an ionomer is used. Polyolefin having a swelling ratio of 55 % or more is extruded over the conductor to form a foamed insulation layer with a foaming degree of 50 % or more using a chemical foaming agent and/or an inert gas. The wire is suitable for high-speed data transmission.

12 Claims, 1 Drawing Sheet

Measuring method of conductor stripping force

FIGURE
Measuring method of conductor stripping force
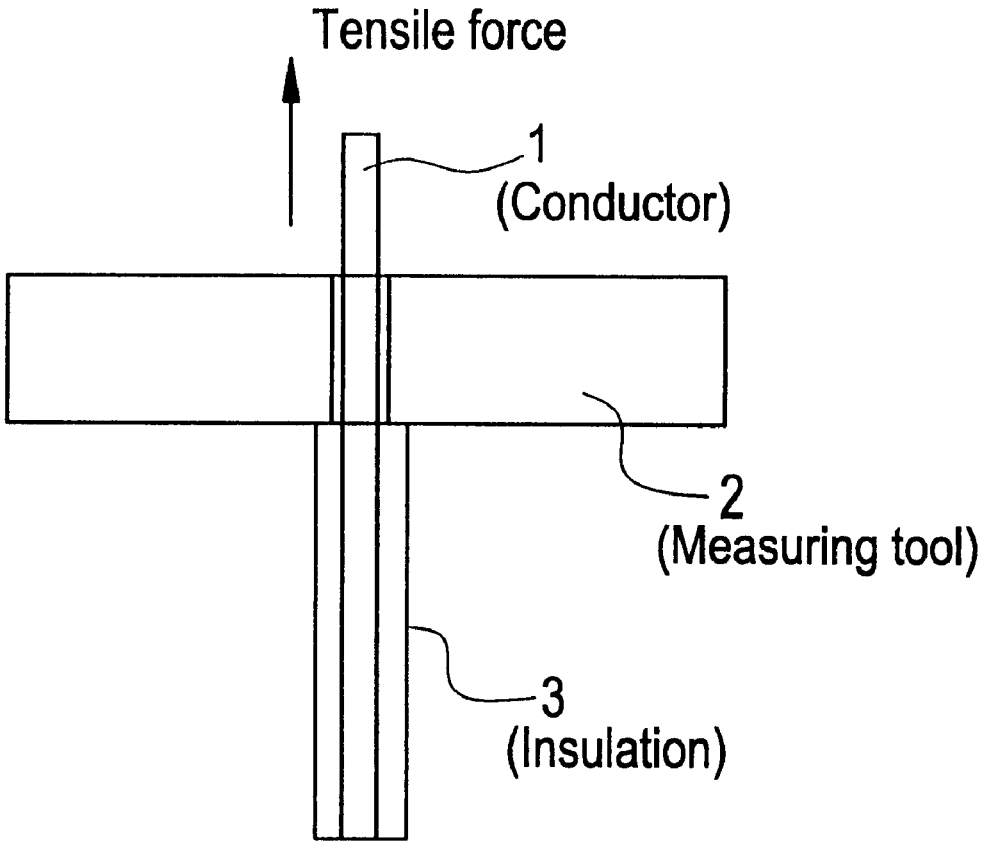

THIN-CONDUCTOR FOAMED-POLYOLEFIN-INSULATED WIRE AND MANUFACTURING METHOD THEREOF

REFERENCE TO A RELATED APPLICATION

This application is a continuation-in-part of application Ser. No. 09/196,740 filed Nov. 20, 1998 now abandoned, which is relied on herein and incorporated by reference.

BACKGROUND OF THE INVENTION

1. Field of the Invention

The present invention relates to a thin-conductor highly-foamed-polyolefin-insulated wire for high-speed data transmission, a multi-core cable comprising the wires thereof, and a manufacturing method of the wire and cable.

2. Description of the Background Art

To achieve a higher foaming degree in the insulation of a foamed-polyolefin-insulated wire for high-speed data transmission, published Japanese patent Tokukosho 61-11412 disclosed a method of using a plastic material having a swelling ratio of 55% or more to fulfill a foaming degree as high as 60% or more. Published Japanese patent Tokukosho 63-56652 disclosed a method of foaming a blend of an ethylene-propylene elastic copolymer, high-density polyethylene, and an ethylene-propylene block copolymer to attain the same result.

The drawback of these conventional methods, which apply the use of a material having a specific swelling ratio or the use of a blend of an ethylene-propylene elastic copolymer and others, is that a weak bonding develops between the insulation layer and the conductor when applied to the production of a thin-conductor foamed-polyolefin-insulated wire, causing the stripping length of the insulation to fluctuate undesirably at the time of termination work. A thin-conductor insulated wire innately has a weaker bonding between the insulation and the conductor due to its smaller contact area between them. A higher degree of foaming in the insulation further weakens the bonding, giving the above-mentioned undesirable result.

In order to strengthen the bonding between the insulation and the conductor, published Japanese patent Tokukosho 48-42314 disclosed a method where a thin unfoamed (solid) insulation layer is applied directly over the conductor before a thin foamed-polyethylene insulation layer is applied. This method, however, has difficulty in producing a highly foamed insulation layer for a thin-conductor wire with a good appearance. In order to keep the same total insulation thickness, an unfoamed insulation layer on the conductor requires a reduction of the foamed insulation thickness. To obtain the same equivalent dielectric constant, the foamed insulation needs to have a higher foaming degree. An extrusion of an insulation layer with a thinner thickness and a higher degree of foaming makes it difficult to produce a thin-conductor highly-foamed insulated wire.

In order to strengthen the bonding between the insulation and the conductor, published Japanese patent Tokukohei 6-16371 disclosed a method where a conductor is cooled just before entering an extruder for producing a foamed-polyolefin-insulated wire. This method too cannot produce a required high degree of foaming for a thin-conductor foamed-polyolefin-insulated wire. In this method, the insulation around the conductor is cooled rapidly to suppress the foaming so that the bonding with the conductor will be enhanced. As with the method of applying a solid insulation layer on the conductor described above, the foamed insulation layer needs to have a higher foaming degree to compensate the higher dielectric constant of the solid insulation layer, making it difficult to produce a thin-conductor highly-foamed thin-insulation wire.

In actual application, increasingly thinner cables are being used for data transmission as in computers to save wiring space, for example. Because the data transmission speed is inversely proportional to the square root of the dielectric constant of an insulation layer, a foamed insulation is used to reduce the dielectric constant. The higher the foaming degree, the higher the transmission speed. For a thick-conductor less-foamed insulated wire, the large contact area between the foamed insulation layer and the conductor facilitates a strong bonding between them.

On the other hand, for a thin-conductor highly-foamed insulated wire, the smaller contact area between the foamed insulation layer and the conductor makes it extremely difficult to achieve a strong bonding between them. If the bonding is weak, when a wire is cut, the conductor will protrude from the cut end, and when the insulation is stripped, the stripped length will fluctuate undesirably. These phenomena are particularly notable in a foamed insulation wire less than 0.4 mm in conductor diameter and 50% or more in foaming degree.

In addition, when the diameter of a foamed insulation layer decreases, it becomes a considerable challenge to obtain a good appearance of the extruded layer. In many cases the foamed insulation layers have a coarse appearance when the insulation thickness is less than 0.8 mm.

SUMMARY OF THE INVENTION

As a result of intensive studies on the above-mentioned problems, the present inventors have found the following facts and completed the present invention.

A highly-foamed-polyolefin-insulated wire which has a conductor of 0.4 mm or less in diameter and an insulation of 0.8mm or less in thickness and which satisfies the following three conditions is suitable for high-speed data transmission:

(a) an equivalent dielectric constant of less than 1.6;

(b) the fluctuation limits of the equivalent dielectric constant of ±0.1; and (c) a conductor stripping force of 100 g/50 mm or more.

The abovementioned insulated wire can be obtained by using polyolefin including 10 weight % or more of a partial metal salt of a copolymer having a comonomer containing carboxylic acid or a carboxylic anhydride group. It is desirable that in the above-mentioned insulated wire, polyolefin having a swelling ratio of 55% or more be extruded over the conductor to form a foamed insulation layer with a foaming degree of 50% or more using a chemical foaming agent and/or an inert gas.

BRIEF DESCRIPTION OF THE DRAWING

The accompanying FIGURE is a perspective illustration showing the measuring method of a bonding strength between the insulation layer and the conductor, or a conductor stripping force.

DETAILED DESCRIPTION OF THE INVENTION

The following are the features of the present invention:

A foamed-polyolefin-insulated wire, 0.4 mm or less in conductor diameter and 0.8 mm or less in insulation thickness, satisfies the following three required conditions:

(a) an equivalent dielectric constant of less than 1.6;

(b) the fluctuation limits of the equivalent dielectric constant of ±0.1; and (c) a conductor stripping force of 100 g/50 mm or more.

The above-mentioned insulated wire is produced by using polyolefin including 10 weight % or more of a partial metal salt of a copolymer having a comonomer containing carboxylic acid or a carboxylic anhydride group.

It is desirable that the above-mentioned insulated wire be produced by extruding polyolefin having swelling ratio of 55% or more over the conductor to form a foamed insulation layer with a foaming degree of 50% or more using a chemical foaming agent and/or an inert gas.

As a partial metal salt of a copolymer having a comonomer containing carboxylic acid or a carboxylic anhydride group, the iononomer produced by Mitsui Dupont Polychemical Co., for example, is available. Hereinafter, the partial metal salt of the copolymer is called "ionomer". In the invention, it is desirable that polyolefin including 10 weight % or more of the ionomer be used.

For a plastic material comprising a foamed insulation layer of the invention, it is desirable that polyolefin having a swelling ratio of 55% or more, preferably 60% or more, be used. There is no upper limit to the swelling ratio of the polyolefin on condition that a foamed insulation layer is satisfactorily obtained. Polyolefin having a higher swelling ratio produces a foamed insulation layer with smaller bubbles in it and accompanying good appearance. Generally, a preferable example of the ratio is about 65%. If the swelling ratio is less than 55%, the bubbles in the insulation have a tendency to enlarge and render an inferior appearance to the insulation layer.

A swelling ratio expressed in percent is obtained at the time of measuring a melt index (MI) at a temperature of 190° C. under a load of 2160 g by a melt indexer stipulated in Japanese Industrial Standard JIS-E6760 or ASTM-D 1238-70. The ratio is calculated by using equation (1) below:

$$\text{Swelling ratio} = 100 \times \frac{(d_s - d_0)}{(d_0)} \quad (1)$$

where $d_s$: diameter of the extruded sample, measured at normal temperature, $d_o$: inside diameter of the orifice set in the melt indexer, measured at normal temperature.

The swelling ratios mentioned in the invention are measured on blended samples of base plastic materials without including a foaming agent, because if a plastic material including a foaming agent is extruded by a melt indexer, the plastic is foamed.

It is desirable that the polyolefin used in the foamed layer of the invention contain ionomer of 10 weight % or more, preferably 20 weight % or more. If the ionomer content is less than 10 weight %, the bonding with a conductor is insufficient.

The ionomer in the invention is a partial metallic salt of a copolymer including a comonomer containing carboxylic acid or a carboxylic anhydride group, typically, a partial metallic salt of a copolymer of ethylene and carboxylic acid or carboxylic anhydride, particularly, α-,β-unstilted carboxylic acid or its carboxylic anhydride. The ionomer may be prepared by the method described in published Japanese patent Tokukosho 39-6810, for example.

More specifically, the ionomer is prepared by cross-linking part or whole of carboxylic acid or a carboxylic anhydride group in a copolymer of ethylene and α-,β-unsaturated carboxylic acid with 3 to 8 carbons or its carboxylic anhydride, such as acrylic acid, methacrylic acid, ethacrylic acid, itaconic acid, and fumaric acid, or in a ternary copolymer that is composed of said copolymer and the third component made of α-,β-unsaturated carboxylic ester with 4 to 8 carbons, such as methyl acrylate, ethyl acrylate, isobutyl acrylate, n-butyl acrylate, methyl methacrylate, ethyl methacrylate, isobutyl methacrylate, n-butyl methacrylate, and dimethyl fumarate. The cross-linking above is carried out through metal ions.

A single partial metallic salt of the copolymer may be used, or a mixture of two or more partial metallic salts of the copolymer may be used.

As mentioned above, the partial metallic salt of the copolymer has a structure in which molecules in a copolymer of ethylene and α-,β-unsaturated carboxylic acid with 3 to 8 carbons or its carboxylic anhydride are cross-linked through metal ions. Desired partial metallic salts are those of zinc, sodium, potassium, and magnesium of a copolymer of ethylene and acrylic acid and/or methacrylic acid. The melt flow rate (MFR) of a partial metallic salt of the copolymer is usually between about 0.1 and 500 g/10 min., desirably between about 1 and 100 g/10 min. If it is less than about 0.1 g/10 min., the extrusion-foaming performance deteriorates, and if more than 500 g/10 min, the foamed layer lacks in mechanical strength.

The content of carboxylic acid or carboxylic anhydride in the copolymer is usually between about 0.5 and 15 mol %, desirably between about 1 and 6 mol %. If it is less than about 0.5 mol %, the bonding strength between the insulation layer and conductor is insufficient, and if more than 15 mol %, the mechanical strength of the foamed insulation layer is inadequate.

In addition, when α-,β-unsaturated carboxylic ester is contained as the third component, the content of the ester is usually between about 0.2 and 15 mol %, desirably between about 1 and 10 mol %.

Metal ions to be used for the cross-linking include monovalent metal ions, such as lithium, sodium, potassium, and cesium ion; divalent metal ions, such as magnesium, calcium, strontium, barium, copper, and zinc ion; and trivalent metal ions, such as aluminum and iron ion. In particular, an insulation layer prepared by using metal ions such as zinc and sodium ions is low in moisture absorption and has little change in electric characteristics, giving desirable results.

The added amount of metal ion used in a form of metal compound varies with the content of acid in the copolymer, the MFE measured at 190° C. and under a load of 2150 g, and other parameters.

The added amount is usually an amount to neutralize carboxylic acid or a carboxylic anhydride group of not less than 10%, desirably between about 15 and 80%.

Polyolefin to be blended with the ionomer for a foamed insulation layer includes polyethylene, polypropylene, ethylene-α olefin copolymer, ethylene-vinyl acetate copolymer, ethylene-ethyl acrylate copolymer, ethylene-methyl acrylate copolymer, and ethylene-propylene rubber. For the polyethylene above, any polyethylene may be selected from the group consisting of low-density, high-density, linear-low-density, and very-low-density polyethylene. For the polypropylene above, a block copolymer or a random copolymer with ethylene may be used besides a polypropylene homopolymer.

It is desirable that the polyolefin above have a smaller dielectric constant for better electric characteristics. However, on condition that the polyolefin is blendable with ionomer and has a swelling ratio of 55% or more, there is no special limit to its dielectric constant. The polyolefin has no special limits on the MFR on condition that it can blend with the ionomer sufficiently so that the extrusion-foaming is successfully carried out. Generally, however, it is desirable that the MFR lie between 0.1 and 20 g/10 min.

A variety of additives may be added in the foaming insulation material of the invention if required. Said additives include an antioxidant, photostabilizer, ultraviolet inhibitor, antistatic agent, lubricant, organic or inorganic filler, metal deactivator, auxidliary foaming agent, nuclide, dye and pigment, cross-linking agent, and auxliary cross-linking agent.

Extrusion-foaming is carried out as described below.

The above-mentioned polyolefin-based material having a swelling ratio of 55% or more is fed into an extruder to form a foamed insulation layer having a thickness of 0.8 mm or less and a foaming degree of 50% or more over a conductor having a diameter of 0.4 mm or less. A thin-conductor highly-foamed-polyolefin-insulated wire is required to satisfy the following three conditions:

(a) the equivalent dielectric constant is less than 1.6;

(b) the fluctuation limits of the equivalent dielectric constant are ±0.1; and (c) the conductor stripping force is 100 g/50 mm or more.

It is desirable that the above-mentioned polyolefin-based material be uniformly mixed by using a single- or multi-screw extruder or a Banbury mixer.

In the invention, because the polyolefin-based material having a specific swelling ratio is highly used, it is possible to produce a foamed-polyolefin-insulated wire having a small conductor diameter of 0.4 mm or less and a foamed-insulation thickness of 0.8 mm or less. In particular, it is even possible to produce a foamed-polyolefin-insulated wire having a conductor diameter as small as 0.2 mm and a foamed-insulation thickness of 0.15 mm with satisfactory foaming conditions and superior bonding between the insulation and the conductor.

The conductor diameter has no lower limit on condition that the wire has sufficient strength. Generally, acceptable conductor stripping force is obtainable down to about 0.1 mm in diameter. The foamed-insulation thickness likewise has no lower limit on condition that the insulation has a uniform, acceptable equivalent dielectric constant and acceptable conductor stripping force. Generally, satisfactory foaming is obtainable down to about 0.1 mm in thickness.

The extrusion-foaming according to the present invention is conducted by feeding polyolefin-based insulation materials including a chemical foaming agent, i.e., a decomposition-type foaming agent, or a physical foaming agent, i.e., an evaporation-type foaming agent, into an extruder to form an insulation layer having a foaming degrees of 50% or more, desirably 60% or more, over the conductor, generally at a melt-extrusion temperature of 130 to 250° C. If the foaming degree is less than 50%, the equivalent dielectric constant increases to such an extent as to decelerate the signal transmission speed. Although the foaming degree has no strict upper limit, if it exceeds 85%, normally a sufficient conductor stripping force cannot be expected. If the extrusion temperature is lower than 130° C., the polyolefin-based material does not melt sufficiently, resulting in a poor appearance. If it is higher than 250° C., the material will scorch. The chemical foaming agents include azodicarbonamide and its metal salt, 4,4'-oxybis (benzenesulfonyl hydrazide), various metal carbonates, dinitrosopentamethylenetetramine, and toluenesulfonylhydrazide. It is preferable that azodicarbonamide be used. The physical foaming agents include nitrogen, argon, carbon dioxide, methane, propane, butane, pentane, hexane, and fluorocarbon. It is preferable that nitrogen be used.

For the purpose of the extrusion-foaming according to the present invention the foaming agents may be blended with the whole polyolefin-based materials, or a master batch of plastic materials including a high-content foaming agent may be prepared beforehand to be dry-blended with the base plastic resin so as to be extruded.

The foaming degree is obtained by calculating equation (2) below using the measured result of capacitance per meter of a foamed-polyolefin-insulated wire:

$$\text{Foaming degree}\ (\%) = 100 \times \frac{(2\varepsilon_0 + 1)(\varepsilon_0 - \varepsilon_s)}{(\varepsilon_0 - 1)(\varepsilon_s + 2\varepsilon_0)} \qquad (2)$$

where $\epsilon_s := C_s \times \log(d_2/d_1)/24.13$. . . (3), $\epsilon_s$: equivalent dielectric constant, $\epsilon_o$: specific dielectric constant of the insulation material before foaming, $C_s$: capacitance of the foamed-plastic insulated wire (pF/m), $d_1$: conductor diameter (mm), $d_2$: outer diameter of the foamed-polyolefin-insulated wire An unfoamed layer that contains no foaming agent may be applied over the foamed layer.

The foamed-polyolefin-insulated wires according to the present invention may be interwined to make a twist-pair cable, or assembled to make a multi-core cable, or paralleled to make a tape-type cable.

The insulation may be cross-led either by a chemical method using a cross-linking agent or by an irradiation method using electron beams or other rays.

The foamed-polyolefin-insulated wire produced by the methods described above is characterized in that it has a conductor diameter of 0.4 mm or less and an insulation thickness of 0.8 mm or less, and satisfies the following three required conditions:

(a) an equivalent dielectric constant of less than 1.6;

(b) the fluctuation limits of the equivalent dielectric constant of ±0.1; and (c) a conductor stripping force of 100 g/50 mm or more.

It is desirable that the equivalent dielectric constant be smaller than 1.5, preferably 1.2 to 1.4. It is essential that the equivalent dielectric constant have little fluctuation, namely, to fall within the range of ±0.1. It is desirable that the conductor stripping force be 200 g/50 mm or more. If the equivalent dielectric constant is 1.6 or higher, the signal transmission speed decelerates undesirably. If the fluctuation of the equivalent dielectric constant exceeds the range of ±0.1, signal transmission characteristics become unstable.

If the conductor stripping force is less than 100 g/50 mm, when a wire is cut, the conductor will protrude from the cut end, and when the insulation is stripped, the stripped length will fluctuate undesirably. There is no upper limit to the conductor stripping force on condition that the thin-conductor foamed-polyolefin-insulated wire satisfies the aforementioned requirements. Generally, a preferable example of the strength is about 200 g/50 mm.

EXAMPLES

In the following, the invention is illustrated further in detail by examples and comparative examples. These examples are not to limit the scope of the invention.

In these examples, the conductor stripping force was measured in a manner shown in the Figure. Namely, the insulation 3 of a sample wire was removed, leaving the insulation as it was in 50 mm length at an end thereof, and the conductor 1 was inserted into the hole of a measuring tool 2, the hole diameter being slightly larger than the conductor diameter, such that the maximum tensile force required to pull out the conductor 1 from the sample wire was measured. The measured value was expressed in terms of gram.

The equivalent dielectric constant was calculated by the equation (3) using the measured results of the capacitance, conductor diameter, and outer diameter.

EXAMPLE 1

Ionomer (an ethylene-methacrylic acid copolymer made by Mitsui Dupont Polychemical Co. by the name "HIMILAN 1650") having an MI of 1.5 and a melting point of 91° C. and including a zinc ion as the metal ion, high-density polyethylene (a product of Mitsui Petrochemical Ind. called "HISEX 5305E") having an MI of 0.8 and a density of 0.953 g/cm$^3$, and azodicarbonamide were blended with a ratio of 50:50:2 and mixed under melting condition by a twin-screw extruder (a product of Ikegai Corp. called "PCM-30") to be pelletized. The plastic material thus prepared was extruded over a copper wire of 0.2 mm in diameter to form a foamed layer having a thickness of 0.15 mm and a foaming degree of 70%. The foamed-polyolefin-insulated wire had a good appearance and sufficient conductor stripping force as high as 400 g/50 mm. Incidentally, a blended sample of the ionomer and high-density polyethylene with a ratio of 50:50 showed a swelling ratio of 70%.

EXAMPLE 2

The ionomer used in Example 1, low-density polyethylene (a product of Mitsui Petrochemical Ind. called "MILATHON 27") having an MI of 2.0 and a density of 0.918 g/cm$^3$, and azodicarbonamide were blended with a ratio of 20:60:2 and mixed under melting condition by a twin-screw extruder (a product of Ikegai Corp. called "PCM-30") to be pelletized. Pellets thus prepared and a polypropylene homopolyer (a product of Mitsubishi Chemical Ind. called "MITSUBISHI POLYPRO MH6") having an MI of 1.2 were dry-blended with a ratio of 82:20. The plastic material was extruded over a copper wire of 0.2 mm in diameter to form a foamed layer having a thickness of 0.15 mm and a foaming degree of 70%. The foamed-polyolefin-insulated wire had a good appearance and sufficient conductor stripping force as high as 250 g/50 mm. The plastic material excluding a foaming agent showed a swelling ratio of 110%.

EXAMPLE 3

The ionomer used in Example 1, very-low-density polyethylene (a product of Sumitomo Chemical Co. called "EXCELLEN VL100") having an MI of 0.8 and a density of 0.90 g/cm$^3$, and azodicarbonamide were blended with a ratio of 30:40:2 and mixed under melting condition by a twin-screw extruder (a product of Ikegai Corp. called "PCM-30") to be pelletized. Pellets thus prepared and an ethylene-propylene block copolymer (a product of Mitsubishi Chemical Ind. called "MITSUBISHI PORYPRO EC8") having an MI of 1.5 were dry-blended with a ratio of 72:30. The plastic material was extruded over a copper wire of 0.2 mm in diameter to form a foamed layer having a thickness of 0.15 mm and a foaming degree of 60%. The foamed-polyolefin-insulated wire had a good appearance and sufficient conductor stripping force as high as 350 g/50 mm. The plastic material excluding a foaming agent showed a swelling ratio of 80%.

EXAMPLE 4

The ionomer used in Example 1, low-density polyethylene (a product of Mitsui petrochemical Ind. called "MILATHON 27") having an MI of 2.0 and a density of 0.918 g/cm$^3$, and a polypropylene homopolymer (a product of Mitsubishi Chemical Ind. called "MITSUBISHI POLYPRO MH6") having an MI of 1.2 were blended with a ratio of 20:60:2 and mixed under melting condition by a twin-screw extruder (a product of Ikegai Corp. called "PCM-30") to be pelletized. Pellets thus prepared were extruded over a copper wire of 0.2 mm in diameter, by a gas-foaming extruder with nitrogen gas being injected, to form a foamed layer having a thickness of 0.15 mm and a foaming degree of 65%. The foamed-polyolefin-insulated wire had a good appearance and sufficient conductor stripping force.

COMPARATIVE EXAMPLES 1 to 3

High-density polyethylene (a product of Mitsui Petrochemical Ind. called "HIZEX 5305E") having an M of 0.8 and a density of 0.953 g/cm$^3$ was extruded without ionomer to form a foamed layer. A blend of low-density polyethylene (a product of Mitsui petrochemical Ind. called "MILATHON 27") having an MI of 2.0 and a density of 0.918 g/cm$^3$ and a polypropylene homopolymer (a product of Mitsubishi Chemical Ind. called "MITSUBISHI POLYPRO MH6") was also extruded without ionomer to form a foamed layer. The results are shown in the columns "Comparative Example 1" and "Comparative Example 2" in the Table. With both samples, the bonding between the insulation layer and the conductor was insufficient and the conductors were easily pulled out from the insulation layers.

As can be seen in the column marked "Comparative Example 3" in the Table, when a base plastic material having a swelling ratio of less than 55% was used, it was difficult to increase the foaming degree and even with a foaming degree of 55%, the surface of the foamed insulation layer became coarse. The results obtained from the examples and comparative examples are summarized in the Table below:

TABLE

| | (Examples) | | | | | | |
|---|---|---|---|---|---|---|---|
| | Example | | | | Comparative Example | | |
| Example No. | 1 | 2 | 3 | 4 | 1 | 2 | 3 |
| Ionomer (1) | 50 | 20 | 30 | 20 | | | 10 |
| Low-density polyethylene (2) | | 60 | | 60 | | 80 | |
| High-density polyethylene (3) | 50 | | | | 100 | | |

TABLE-continued

| | (Examples) | | | | | | |
|---|---|---|---|---|---|---|---|
| | Example | | | | Comparative Example | | |
| Example No. | 1 | 2 | 3 | 4 | 1 | 2 | 3 |
| High-density polyethylene (4) | | | | | | | 90 |
| Very low-density polyethylene (5) | | | 40 | | | | |
| Polypropylene (6) | | 20 | | 20 | | 20 | |
| Polypropylene (7) | | | 30 | | | | |
| Azodicarbonamide | 2 | 2 | 2 | 2 | 2 | 2 | 2 |
| Swelling ratio (%) | 70 | 110 | 80 | 110 | 45 | 105 | 45 |
| Conductor diameter (mm) | 0.2 | 0.2 | 0.2 | 0.2 | 0.2 | 0.2 | 0.2 |
| Thickness of foamed layer (mm) | 0.15 | 0.15 | 0.15 | 0.15 | 0.15 | 0.15 | 0.15 |
| Foaming degree (%) | 70 | 70 | 60 | 65 | 45 | 70 | 55 |
| Conductor stripping force (g/50 mm) | 400 | 250 | 350 | 300 | <50 | <50 | <50 |
| Equivalent dielectric constant | 1.34 | 1.34 | 1.45 | 1.39 | 1.65 | 1.34 | 1.52 |
| Range of fluctuation of dielectric constant | ±0.03 | ±0.03 | ±0.05 | ±0.05 | ±0.05 | ±0.04 | ±1.1 |
| Appearance of insulation layer | Good | Good | Good | Good | Good | Good | Coarse |

Note:
(1) MI = 1.5, melting point = 91° C., metal ion: ionomer of zinc (brand name: HIMILAN 1650)
(2) MI = 2.0, low-density polyethylene (brand name: MILATHON 27)
(3) MI = 0.8, high-density polyethylene (brand name: HIZEX 5305E)
(4) MI = 5.2, high-density polyethylene (brand name: HIZEX 2200J)
(5) MI = 0.8, density = 0.90, very low-density polyethylene (brand name: EXCELLEN VL100)
(6) MI = 1.2, polypropylene homopolymer (brand name: MITSUBISHI POLYPRO MH6)
(7) MI = 1.5, ethylene-propylene block copolymer (brand name: MITSUBISHI POLYPRO EC8)

What is claimed is:

1. A method of manufacturing a foamed-polyolefin-insulated wire comprising a conductor having a diameter of 0.4 mm or less and an insulation layer having a thickness of 0.8 mm or less, wherein the wire has the following properties:

(a) an equivalent dielectric constant of less than 1.6;

(b) a fluctuation of the equivalent dielectric constant within a range of ±0.1; and (c) conductor stripping force of 100 g/50 mm or more, wherein the insulation layer comprises a polyolefin having at least 10 weight % of a partial metal salt of a copolymer having a comonomer selected from the group consisting of carboxylic acid and a carboxylic anhydride group, wherein the partial metal salt of a copolymer is a partial metal salt of a copolymer of ethylene and a carboxylic acid or a carboxylic anhydride;

the method comprising:

extruding a polyolefin having a swelling ratio of 55% or more over the conductor to form a foamed insulation layer having a foaming degree of 50% or more, wherein the polyolefin comprises at least one member selected from the group consisting of a chemical foaming agent and an inert gas.

2. A foamed-polyolefin-insulated wire comprising:

a conductor having a diameter of 0.4 mm or less, and an insulation layer having a thickness of 0.8 mm or less, wherein the wire has the following properties:

(a) an equivalent dielectric constant of less than 1.6;

(b) a fluctuation of the equivalent dielectric constant within a range of ±0.1; and (c) conductor stripping force of 100 g/50 mm or more, wherein the insulation layer comprises a polyolefin having at least 10 weight % of a partial metal salt of a copolymer having a comonomer selected from the group consisting of carboxylic acid and a carboxylic anhydride group, wherein the partial metal salt of a copolymer is a partial metal salt of a copolymer of ethylene and a carboxylic acid or a carboxylic anhydride, wherein the carboxylic acid or the carboxylic anhydride is an alpha, beta-unsaturated carboxylic acid with 3–8 carbon atoms.

3. A foamed-polyolefin-insulated wire comprising:

a conductor having a diameter of 0.4 mm or less, an insulation layer having a thickness of 0.8 mm or less, and a third component which is an alpha, beta-unsaturated carboxylic acid ester containing 4–8 carbon atoms, wherein the wire has the following properties:

(a) an equivalent dielectric constant of less than 1.6;

(b) a fluctuation of the equivalent dielectric constant within a range of ±0.1; and (c) conductor stripping force of 100 g/50 mm or more, wherein the insulation layer comprises a polyolefin having at least 10 weight % of a partial metal salt of a copolymer having a comonomer selected from the group consisting of carboxylic acid and a carboxylic anhydride group, wherein the partial metal salt of a copolymer is a partial metal salt of a copolymer of ethylene and a carboxylic acid or a carboxylic anhydride.

4. The foamed-polyolefin-insulated wire according to claim 3, wherein the alpha-beta unsaturated carboxylic acid ester is a member selected from the group consisting of methyl acrylate, ethyl acrylate, isobutyl acrylate, n-butyl acrylate, methyl methacrylate, ethyl methacrylate, isobutyl methacrylate, n-butyl methacrylate and dimethyl fumarate.

5. The foamed-polyolefin-insulated wire according to claim 3, wherein the alpha, beta-unsaturated carboxylic acid ester is present in an amount of from 0.2 to 15 mol. %.

6. foamed-polyolefin-insulated wire comprising a conductor having a diameter of 0.4 mm or less and an insulation layer having a thickness of 0.8 mm or less, wherein the wire has the following properties:

(a) an equivalent dielectric constant of less than 1.6;

(b) a fluctuation of the equivalent dielectric constant within a range of ±0.1; and (c) conductor stripping force of 100 g/50 mm or more, wherein the insulation layer comprises a polyolefin having at least 10 weight % of a partial metal salt of a copolymer having a comonomer selected from the group consisting of carboxylic acid and a carboxylic anhydride group, wherein the partial metal salt is at least one member selected from the group consisting of zinc, sodium, potassium and magnesium salts of a copolymer of at least one of ethylene and acrylic acid, and ethylene and methacrylate acid.

7. A method of manufacturing the foamed-polyolefin-insulated wire defined in claim 6, comprising:

extruding a polyolefin having a swelling ratio of 55% or more over the conductor to form a foamed insulation layer having a foaming degree of 50% or more, wherein the polyolefin comprises at least one member selected from the group consisting of a chemical foaming agent and an inert gas.

8. A foamed-polyolefin-insulated wire comprising a conductor having a diameter of 0.4 mm or less and an insulation layer having a thickness of 0.8 mm or less, wherein the wire has the following properties:

(a) an equivalent dielectric constant of less than 1.6;

(b) a fluctuation of the equivalent dielectric constant within a range of ±0.1; and (c) conductor stripping force of 100 g/50 mm or more, wherein the insulation layer comprises a polyolefin having at least 10 weight % of a partial metal salt of a copolymer having a comonomer selected from the group consisting of carboxylic acid and a carboxylic anhydride group, wherein a melt flow rate of the partial metal salt of the copolymer is between 0.1 and 500 g/10 min.

9. A method of manufacturing the foamed-polyolefin-insulated wire defined in claim 8, comprising:

extruding a polyolefin having a swelling ratio of 55% or more over the conductor to form a foamed insulation layer having a foaming degree of 50% or more, wherein the polyolefin comprises at least one member selected from the group consisting of a chemical foaming agent and an inert gas.

10. A foamed-polyolefin-insulated wire comprising a conductor having a diameter of 0.4 mm or less and an insulation layer having a thickness of 0.8 mm or less, wherein the wire has the following properties:

(a) an equivalent dielectric constant of less than 1.6;

(b) a fluctuation of the equivalent dielectric constant within a range of ±0.1; and (c) conductor stripping force of 100 g/50 mm or more, wherein the insulation layer comprises a polyolefin having at least 10 weight % of a partial metal salt of a copolymer having a comonomer selected from the group consisting of carboxylic acid and a carboxylic anhydride group, made by the process comprising extruding a polyolefin having a swelling ratio of 55% or more over said conductor to form a foamed insulation layer, having a foaming degree of 50% or more, employing at least one member selected from the group consisting of a chemical foaming agent and an inert gas.

11. A method of manufacturing a foamed-polyolefin-insulated wire comprising a conductor having a diameter of 0.4 mm or less and an insulation layer having a thickness of 0.8 mm or less, wherein the wire has the following properties:

(a) an equivalent dielectric constant of less than 1.6;

(b) a fluctuation of the equivalent dielectric constant within a range of ±0.1; and (c) conductor stripping force of 100 g/50 mm or more, wherein the insulation layer comprises a polyolefin having at least 10 weight % of a partial metal salt of a copolymer having a comonomer selected from the group consisting of carboxylic acid and a carboxylic anhydride group, wherein the carboxylic acid or carboxylic anhydride in the copolymer is present in an amount between about 0.5 and 15 mol. %;

the method comprising:

extruding a polyolefin having a swelling ratio of 55% or more over the conductor to form a foamed insulation layer having a foaming degree of 50% or more, wherein the polyolefin comprises at least one member selected from the group consisting of a chemical foaming agent and an inert gas.

12. A method of manufacturing a foamed-polyolefin-insulated wire comprising a conductor having a diameter of 0.4 mm or less and an insulation layer having a thickness of 0.8 mm or less, wherein the wire has the following properties:

(a) an equivalent dielectric constant of less than 1.6;

(b) a fluctuation of the equivalent dielectric constant within a range of ±0.1; and (c) conductor stripping force of 100 g/50 mm or more, wherein the insulation layer comprises a polyolefin having at least 10 weight % of a partial metal salt of a copolymer having a comonomer selected from the group consisting of carboxylic acid and a carboxylic anhydride group, wherein the polyolefin blended with the partial metal salt of the copolymer to produce the insulation layer is a member selected from the group consisting of polyethylene, polypropylene, ethylene-alpha olefin copolymer, ethylene-vinyl acetate copolymer, ethylene-ethyl acrylate copolymer, ethylene-methacrylate copolymer and ethylene-propylene rubber;

the method comprising:

extruding a polyolefin having a swelling ratio of 55% or more over the conductor to form a foamed insulation layer having a foaming degree of 50% or more, wherein the polyolefin comprises at least one member selected from the group consisting of a chemical foaming agent and an inert gas.

* * * * *